US005351943A

United States Patent [19]

Milz

[11] Patent Number: 5,351,943

[45] Date of Patent: Oct. 4, 1994

[54] MULTIPLE VICE FOR CLAMPING AT LEAST TWO WORKPIECES

[75] Inventor: Pankraz Milz, Kempten, Fed. Rep. of Germany

[73] Assignee: Saurer-Allma GmbH, Kempten, Fed. Rep. of Germany

[21] Appl. No.: 772,097

[22] Filed: Oct. 7, 1991

[30] Foreign Application Priority Data

Oct. 6, 1990 [DE] Fed. Rep. of Germany ..... 4031746

[51] Int. Cl.[5] ..... B25B 1/10

[52] U.S. Cl. ..... 269/246; 269/43; 269/153; 269/242

[58] Field of Search ..... 269/241, 246, 906, 271, 269/279, 280, 282, 242, 152, 153, 43

[56] References Cited

U.S. PATENT DOCUMENTS 3,774,898 11/1973 O'Neil et al. ..... 269/906
4,341,375 7/1982 Romanin ..... 269/906
4,569,509 2/1986 Good ..... 269/246
4,669,712 6/1987 Krause ..... 269/32
4,934,674 6/1990 Bernstein ..... 269/242
5,098,073 3/1992 Lenz ..... 269/906

FOREIGN PATENT DOCUMENTS 2308175 5/1974 Fed. Rep. of Germany .
3708021 9/1988 Fed. Rep. of Germany .
2178985 2/1987 United Kingdom .

*Primary Examiner*—Bruce M. Kisliuk
*Assistant Examiner*—Eileen P. Morgan
*Attorney, Agent, or Firm*—Jacobson, Price, Holman & Stern

[57] ABSTRACT

A multiple vise includes fixed jaws (7, 8) at the opposite ends of a vise body (1) and movable jaws (5, 6) located between the fixed jaws and cooperating therewith to provide two vises. The two movable jaws (5, 6) and thus the two vises are operated simultaneously by a two-part spindle (11, 12) with opposite screw threads (15, 16). A power amplifier (28, 29, 34) is provided between the spindle parts (11, 12) and, in the clamping position, urges the spindle parts away from each other.

15 Claims, 3 Drawing Sheets

MULTIPLE VICE FOR CLAMPING AT LEAST TWO WORKPIECES

FIELD OF THE INVENTION

This invention relates to a multiple vise for the clamping of at least two workpieces, comprising a vise body having fixed jaws at opposite ends thereof, wherein two movable jaws are mounted between the two fixed jaws, the movable jaws being movable together and each being disposed towards a fixed jaw.

BACKGROUND OF THE INVENTION

Multiple vises which can be used to clamp several workpieces next to each other, so that they can be worked upon simultaneously or sequentially are known. British Patent Application No 2178985 discloses one such multiple vise. In this arrangement fixed jaws are mounted near the ends of a vise body. Between the fixed jaws there are provided movable jaws, the facing surfaces of which are inclined. A clamping element, in the form of a wedge fitting between the inclined surfaces, can be moved along a direction perpendicular to the direction of clamping of the workpieces, thereby simultaneously clamping the two workpieces. In particular, it is proposed that one of the fixed jaws shall be adjustably mounted so that the total clamping width can be altered.

Other known vise assemblies comprise various combinations of fixed jaws and movable jaws mounted on a base plate, so that several workpieces may be separately clamped next to each other.

An object of the present invention is to provide a multiple vise which enables high clamping forces to be applied, as may be brought about by rotation of a threaded spindle or the like. In particular, it is an object of the invention to provide an apparatus which is easy to use in such a way that several workpieces can be secured in a single operation, and with substantially uniform clamping forces. Moreover, it is an object of the invention to provide such a vise in which the accessibility of the clamping assembly is not hindered by the workpieces secured therein.

SUMMARY OF THE INVENTION

To achieve these objects, the invention is based on an apparatus of the type first described above. According to the invention, a two-part spindle is provided, extending along a guide in the vise body. The two parts of the spindle can be rotated together and are movable relative to each other in the axial direction. Each part of the spindle cooperates with one of the movable jaws by means of counter-rotating threads, and cooperates with means for increasing the clamping forces which in the clamping position urge the spindle parts away from each other.

By means of the spindle it is possible to operate the movable jaws from one end of the multiple vise, ie from a position which is in general easily accessible. This also permits several such multiple vises to be mounted next to each other, eg on a base plate.

By means of the counter-rotating threads the movable jaws can be so controlled that they clamp the workpieces in the same operation. The invention provides in particular that, despite the mutual operation of the spindle, considerably higher clamping forces can be applied, which exceed that which can be applied to the spindle. It is convenient for these clamping forces to be applied simply by urging apart the two spindle parts and the movable jaws. This simplifies the construction of the means for increasing the clamping forces.

The means for increasing the clamping forces can have various forms. It can be a servo-apparatus, which is supplied by an external power source, eg a hydraulic or pneumatic supply. Preferably, however, the means for increasing the clamping forces is a power amplifier, which is driven by operation of the spindle. Such a power amplifier can, for example, be a mechanical arrangement. Such power amplifiers are known from DE-OS 2308175 and DE-OS 3708021.

Instead of a mechanical power amplifier, a different form of power amplifier, eg a hydraulic power amplifier, also driven by operation of the spindle, can be provided.

Preferably, at least one of the parts of the spindle is hollow and receives the drive means for the means for increasing the clamping forces. This drive means can, for example, be a drive shaft. Alternatively, a pressure line can be led through the hollow spindle.

In a preferred embodiment, the two spindle parts contain the means for increasing the clamping forces. It is particularly preferred that the one spindle part is in the form of a pipe and receives the drive spindle of the power amplifier, while the other spindle part is provided with at least one hollow into which the first spindle part extends and which receives the power amplifier. The power amplifier is in this case located between the end of the first spindle part and the inner end of the hollow.

In order to retain the axial movement between the two spindle parts, it is desirable to provide a longitudinal aperture arrangement with a movable bolt between the spindle parts.

It has proven desirable for the two spindle parts to be mounted on the vise body in a sprung manner and when unloaded to be displaced a little from the operating position. This enables first one workpiece to be secured between a fixed jaw and the corresponding movable jaw; thereafter, the two-part spindle moves into its operating position and the second workpiece can be secured.

Preferably, movable jaws are used which each surround a sliding member which in turn cooperates with the spindle parts, together with an exchangeable jaw element mounted on each sliding member. In this way, the jaws can be exchanged to enable a clamping width appropriate to any individual workpiece to be achieved.

In a preferred form of construction, a sleeve is provided which surrounds one of the spindle parts and determines the axial position of the spindle. This sleeve preferably cooperates with the sprung elements which displace the two spindle parts somewhat out of their middle position.

A further feature of the invention is a clip connection between the sleeve and the spindle parts. Such an arrangement permits adjustment of the spindle parts relative to the sleeve or the vise body. The enables adjustment of the spindle and the movable jaws in such a way that the clamping width of the two cooperating pairs of jaws can be varied over a wide range. In particular, the clamping widths of the two pairs of jaws can be widely different.

BRIEF DESCRIPTION OF THE DRAWINGS

One embodiment of the invention will now be described, by way of illustration only, with reference to the accompanying drawings, wherein.

DETAILED DESCRIPTION

Figure 1:
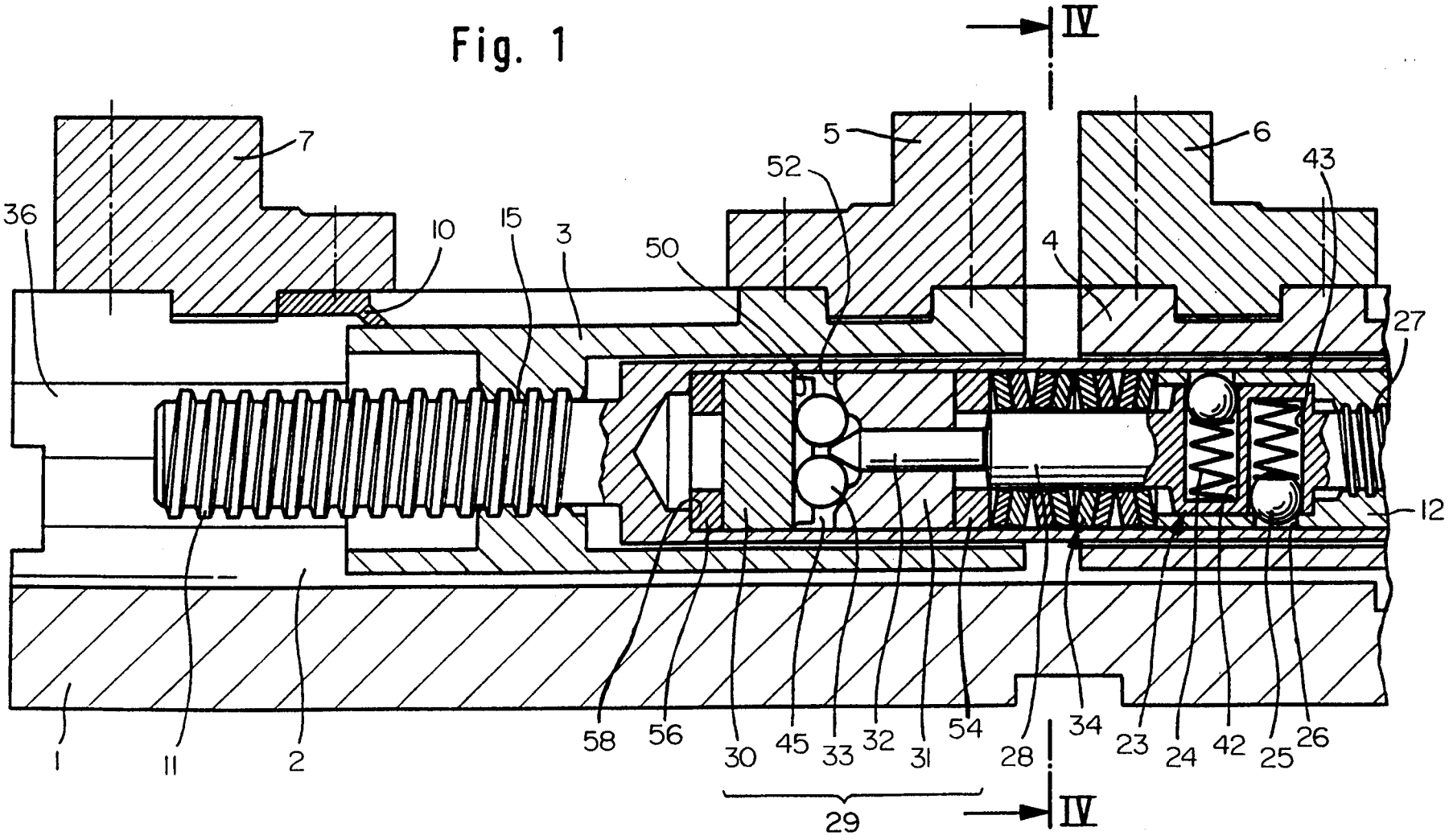
FIG. 1 is an axial cross-sectional view of the left hand part of a multiple vise according to the invention.
Figure 2:
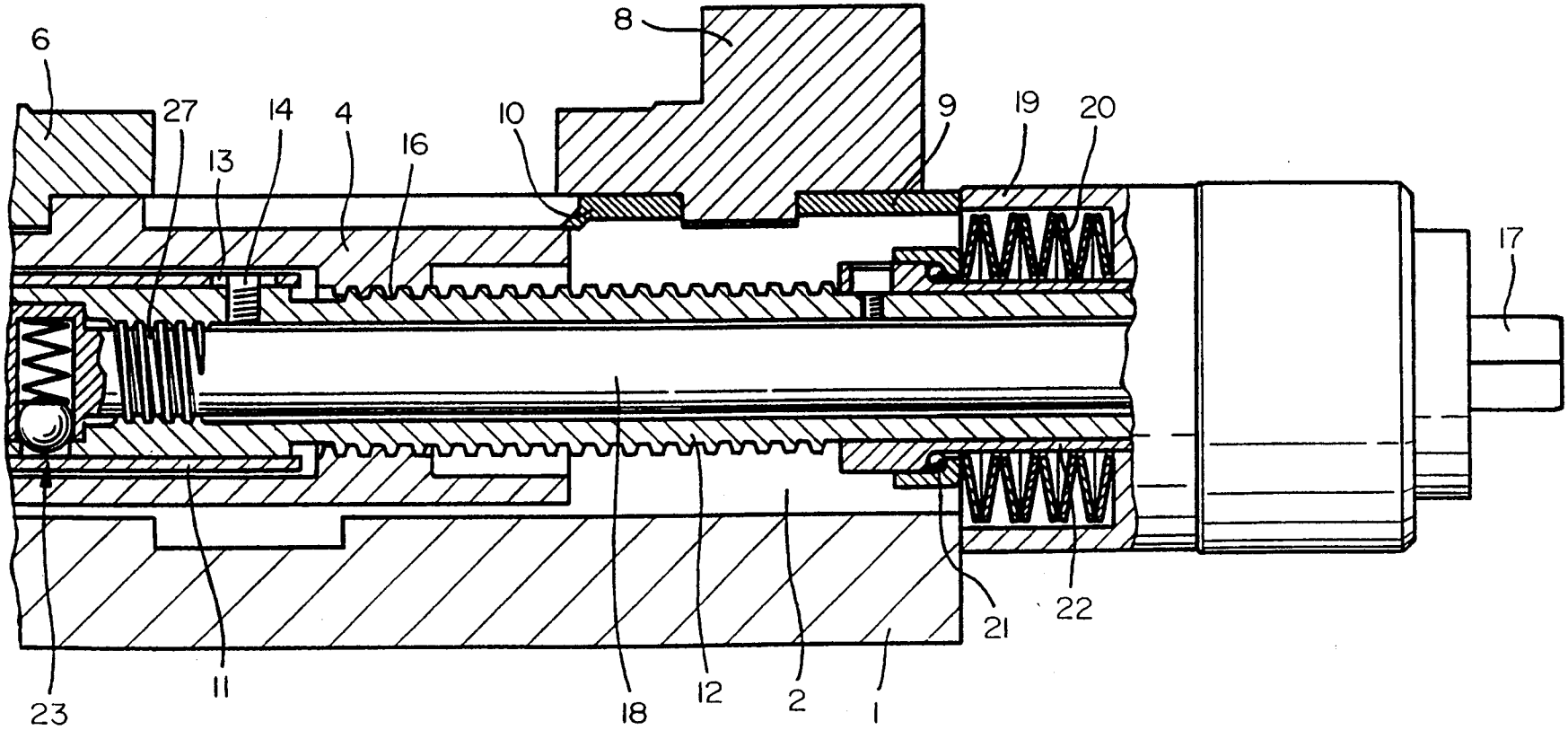
FIG. 2 is a view similar to FIG. 1 of the right-hand part of the multiple vise of the invention.

Referring first to FIGS. 1 and 2, a vise body 1 is provided with a longitudinal recess or groove 2 which extends over substantially the whole length of the vise body 1. The groove 2 opens upwardly.

Figure 4:
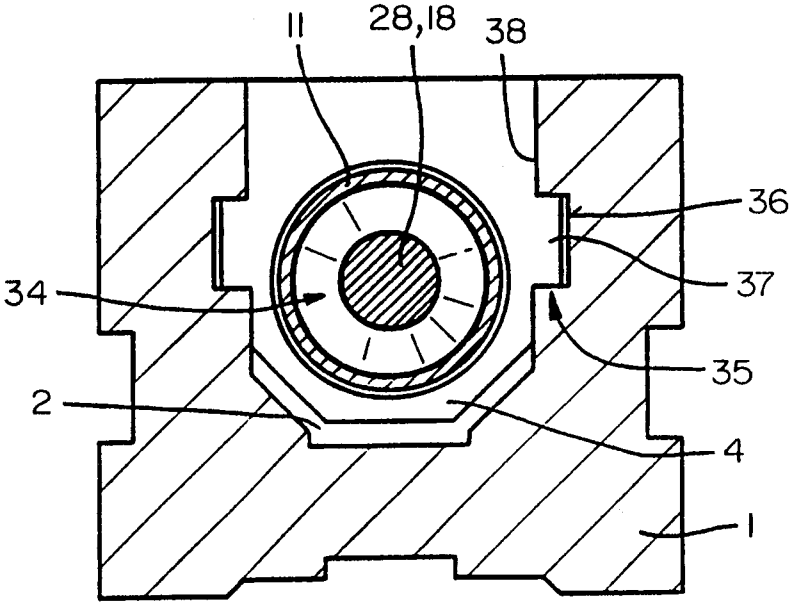
FIG. 4 is a cross sectional view taken along line IV—IV in FIG. 1.

The groove 2 receives sliding members 3,4 which are held in guides 35 (see FIG. 4) within the groove 2. The guides 35 serve to retain both sliding members 3,4. In certain cases, separate guides can be provided for the two sliding members 3,4. The guide 35 comprises essentially a recess 36 which receives a projection 37 on the respective sliding members 3,4. The projection 37 serves for vertical alignment of the sliding members 3,4, while the guide surfaces 38 provide lateral guidance.

The sliding members 3,4 carry movable jaws 5,6. Fixed jaws 7,8 are mounted at the ends of the vise body 1, preferably such that projections 40 on the fixed jaws 7,8 engage in grooves 39 provided in the vise body 1 (see FIG. 1). Screws 41 secure the fixed jaws to the vise body 1.

Figure 3:
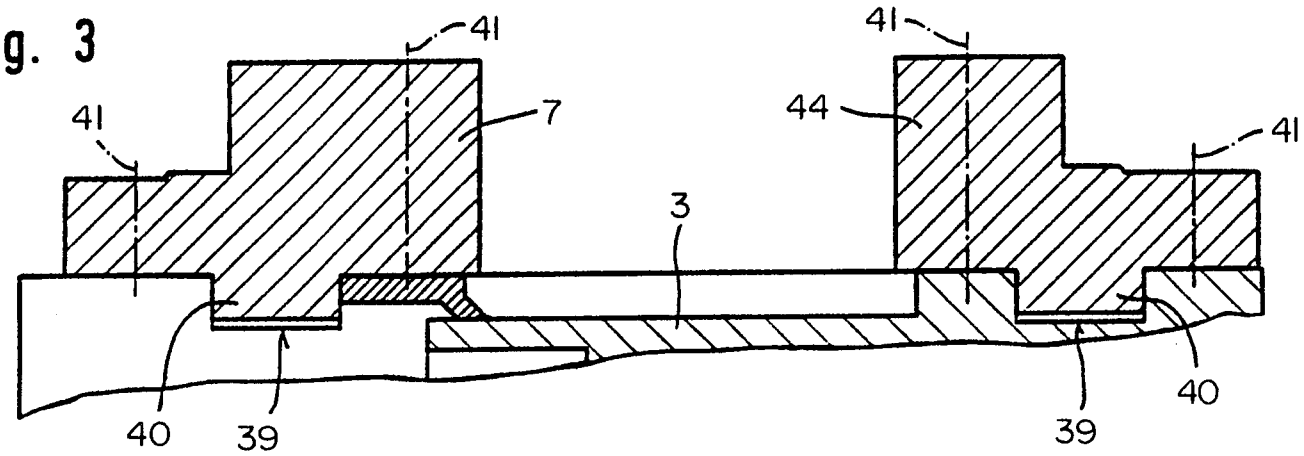
FIG. 3 is a detailed cross-sectional view of part of the vise of FIG. 1.

As can be seen from FIG. 3, the fixed jaws 7,8 can be mounted on the vise body 1 in the reversed position. The same is true for a jaw element 44 which can, for example, be identical to the movable jaw 5. Alternatively, a different jaw element can be used, and the same is the case for the movable jaw 6.

Covers 9,10 are provided on the upper side of the vise body 1. The covers 10 cooperate with the sliding members 3,4 and prevent shavings or the like falling down into the groove 2. The cover 9 under the fixed jaw 8 is also detachable as the reaction plate 19 to allow insertion of the movable jaws 5, 6 during assembly.

The sliding members 3,4 are hollow and contain a spindle, which comprises first and second spindle parts 11,12. The spindle parts 11,12 can only be rotated together, in the same sense, and not in opposite senses. The spindle parts 11,12 are however relatively movable to a small extent in the axial direction. This relative axial displacement of the spindle parts 11,12 is made possible by a longitudinal aperture arrangement 13 with a bolt 14 which engages in the second spindle part 12.

The first spindle part 11 cooperates via a thread 15 with the sliding member 3, while the second spindle part 12 is operably linked to the sliding member 4 via a thread 16. The threads 15,16 are in opposite senses, so that rotation of the spindle in one direction causes the movable jaws 5,6 to move closer together, and rotation in the other direction causes the movable jaws 5,6 to move apart.

Rotation of the spindle is brought about by means of a crank handle (not shown) which is located on a square bolt 17. The square bolt 17 acts on the rightmost end of a drive shaft 18 or is formed integrally therewith.

The drive shaft 18 is provided with bores 42,43, each containing a spring 24 and a ball 25, such that the ball 25 engages in a hole 26 of smaller diameter provided in the second spindle part 12. The components in the bores 42,43 constitute a slipping clutch 23, which slips above a certain torque and permits rotation of the drive shaft 18 relative to the spindle parts 11,12.

The first spindle part 11 has on its left end (as shown in the drawings) the thread 15 and in its right end a hollow portion of boring 45. This hollow portion 45 receives a power amplifier 29 as well as a part of the spindle part 12. The power amplifier comprises a first pressure plate 30 and a second pressure plate 31, between which are arranged cylindrical rollers 33. Rollers 33 engage a flat surface 50 on pressure plate 30 and an inclined surface 52 on pressure plate 31. A wedge bolt 32 can be moved between the rollers 33 and push them apart. In this manner, the separation of the pressure plates 30,31 is increased.

Operation of the power amplifier 29, is produced by moving bolt 32, to the left between rollers 33 by moving the bolt-like forepart 28 of the drive shaft 18 to the left so that rollers 33 are separated and pressure plates 30 and 31 are moved apart. The pressure plate 31 acts via an intermediate ring 54 on a plate spring assembly 34; disposed in front of the front end of the second spindle part 12. The pressure plate 30 of the power amplifier 29 abuts via intermediate ring 56 against the reduced diameter shoulder portion 58 of the hollow portion 45.

A sleeve 22 is attached to the right hand (as shown in the drawings) end of the second spindle part 12. The sleeve 22 carries a roller bearing, the outer ring of which is designated 21. A plate spring assembly 20 acts between the ring 21 and a reaction plate 19. The reaction plate 19 accommodates, for example, further means for limiting relative tilting movement of the drive shaft 18 and the second spindle part 12. These parts are known per se and are not described in more detail.

When the square bolt 17 is rotated by means of a crank, the drive shaft 18 rotates, rotating with it (via the slipping clutch 23) the second spindle part 12 and hence (via the bolts 14) also the first spindle part 11. The sliding members 3,4 and hence the movable jaws 5,6 are thereby displaced by means of the threads 15,16. The arrangement is such that the spindle parts 11,12 and the movable jaws 5,6 are located somewhat outwardly of their middle positions where jaws 5, 6 are situated exactly centrally between jaws 7, 8. In the non-clamped state the ringed spindle parts and jaws 5, 6 are somewhat to the left in the direction of fixed jaw 7 by means the plate spring assembly 20. In this way, a workpiece can first be clamped between the jaws 7,5. As soon as the movable jaw 5 contacts the workpiece, the spindle parts 11, 12 are displaced against the action of the plate spring assembly 20 to the right against the reaction plate 19. Then a workpiece can be clamped between the movable jaw 6 and the fixed jaw 8.

Further rotation of the square bolt releases the slipping clutch 23, as the strength of the springs 24 is exceeded and the balls 25 are pushed out of the bores 26.

Now the drive spindle 18 and screw thread 27 thereon can be rotated relative to the second spindle part 12. The drive shaft 18 is thereby displaced forwardly, depending on the pitch of the thread 27, against the power amplifier and presses with its bolt-like forepart 28 on the wedge bolt 32. The pushing-apart of the pressure plates 30,31 by the radially outward displacement of rollers 33 acts via the plate spring assembly 34 on the second spindle part 12. The spindle parts 11,12 are pressed apart and a correspondingly higher clamping force is thereby applied to the movable jaws 5,6.

The plate spring assembly 34 serves to maintain the applied clamping pressure during placement of the workpieces.

When clamping is released, the wedge bolt 32 releases the pressure rollers 33, so that the separation of the pressure plates 30,31 can be reduced. If the power amplifier is not provided with means for reducing the separation of the pressure plates 30,31, it is desirable for return springs to be provided between the spindle part 11 and the vise body 1, which serve to ensure that the separated spindle parts 11,12 return towards each other.

I claim:

1. A multiple vise for the clamping of at least two workpieces simultaneously, comprising:

a vise body;

guide means in said vise body;

two fixed jaws mounted in relative spaced relationship on said vise body;

means for rigidly mounting said fixed jaws on said vise body;

two movable jaw means mounted on said vise body between said two fixed jaws in sliding engagement with said guide means for substantially linear movement relative to said fixed jaws and each other, so that each movable jaw means is movable between clamping and non-clamping positions in cooperation with one of said fixed jaws;

spindle means having first and second spindle parts rotatably mounted within said vise body and having opposite screw threads thereon, each screw thread being engaged with a cooperating screw thread on a respective one of said movable jaw means, and said spindle parts being relatively movable with respect to each other in a direction substantially parallel to the direction of movement of said jaw means, so that rotation of said spindle parts in one direction simultaneously moves said movable jaw means apart and toward said clamping position with respective fixed jaws and rotation of said spindle parts in the opposite direction moves said movable jaw means toward each other and said non-clamping position and away from said respective fixed jaws;

a drive shaft rotatably disposed within said spindle parts for relative rotation with respect thereto and releasably engageable with said spindle means for rotating said first and second spindle parts; and clamping force increasing means interposed between said first and second spindle parts for urging said spindle parts away from each other in the clamping position.

2. The multiple vise as claimed in claim 1 wherein:

said clamping force increasing means comprises power amplifier means operated by said drive shaft.

3. The multiple vise as claimed in claim 2 wherein:

a hollow portion is provided in said first spindle part;

said second spindle part extends into said hollow portion in said first spindle part; and said power amplifier means is disposed within said hollow portion.

4. The multiple vise as claimed in claim 2 and further comprising:

a hollow portion in one of said spindle parts, said clamping force increasing means being disposed within said hollow portion.

5. The multiple vise as claimed in claim 2 wherein:

a longitudinal aperture is provided in one of said spindle parts; and said power amplifier means comprises a movable bolt operated means mounted on the other spindle part and movable in said longitudinal aperture.

6. The multiple vise as claimed in claim 1 and further comprising:

a hollow portion in one of said spindle parts, said clamping force increasing means being disposed within said hollow portion.

7. The multiple vise as claimed in claim 1 wherein:

a longitudinal aperture is provided in one of said spindle parts; and said clamping force increasing means comprises a movable bolt operated means mounted on the other spindle part and movable in said longitudinal aperture.

8. The multiple vise as claimed in claim 7 and further comprising:

resilient means mounted on said vise body in engagement with said spindle means for urging said spindle parts and said movable jaw means a small distance displaced from a central position of said movable jaw means between said fixed jaws in the non-clamping position.

9. The multiple vise as claimed in claim 1 and further comprising:

resilient means mounted on said vise body in engagement with said spindle means for urging said spindle parts and said movable jaw means a small distance displaced from a central position of said movable jaw means between said fixed jaws in the non-clamping position.

10. The multiple vise as claimed in claim 9 and further comprising:

a sleeve means surrounding and engaging a part of one of said spindle parts and engaging said resilient means in cooperating relationship for determining said displacement of said movable jaw means from said central position.

11. The multiple vise as claimed in claim 10 wherein:

said movable jaw means each comprise a slide member mounted in said vise body in sliding engagement with said guide means, a respective jaw member removably mounted on said slide member, and a cooperating screw thread on said slide means operatively engaging a respective screw thread on one of said spindle parts.

12. The multiple vise as claimed in claim 9 wherein:

said clamping force increasing means comprises power amplifier means operated by said drive means.

13. The multiple vise as claimed in claim 1 wherein:

said movable jaw means each comprise a slide member mounted in said vise body in sliding engagement with said guide means, a respective jaw member removably mounted on said slide member; and a cooperating screw thread is provided on said slide means operatively engaging a respective screw thread on one of said spindle parts.

14. The multiple vise as claimed in claim 13 wherein:

said clamping force increasing means comprises power amplifier means operated by said drive means.

15. The multiple vise as claimed in claim 13 and further comprising:

a hollow portion in one of said spindle parts, said clamping force increasing means being disposed within said hollow portion.

* * * * *